US005759953A

United States Patent [19]

Defieuw et al.

[11] Patent Number: 5,759,953

[45] Date of Patent: Jun. 2, 1998

[54] THERMOGRAPHIC RECORDING MATERIAL WITH IMPROVED SLIP PROPERTIES

[75] Inventors: Geert Defieuw, Kessel-Lo; Jan Gilleir, Mortsel; Wim Muĕs, Tremelo; Robert Van Haute, Temse, all of Belgium

[73] Assignee: Agfa-Gevaert, Mortsel, Belgium

[21] Appl. No.: 753,795

[22] Filed: Nov. 29, 1996

[30] Foreign Application Priority Data

Nov. 27, 1995 [EP] European Pat. Off. ..... 95203246

[51] Int. Cl.[6] ..... B41M 5/40

[52] U.S. Cl. ..... 503/210; 427/152; 503/226

[58] Field of Search ..... 427/152; 503/200, 503/202, 210, 226

[56] References Cited

FOREIGN PATENT DOCUMENTS

WO9411199 5/1994 WIPO ..... 503/210

WO9414618 7/1994 WIPO ..... 503/210

WO9512495 5/1995 WIPO ..... 503/210

*Primary Examiner*—Bruce H. Hess

*Attorney, Agent, or Firm*—Baker & Botts, L.L.P.

[57] ABSTRACT

A recording material comprising at least one thermosensitive element, comprising a substantially light-insensitive organic silver salt and an organic reducing agent therefor in thermal working relationship therewith, on a support, characterized in that an outermost layer of said recording material comprises at least one solid lubricant having a melting point below 150° C. and at least one liquid lubricant in a binder, wherein at least one of said lubricants is a phosphoric acid derivative. The outermost layer of the recording material in contact with the heat source during the thermal image forming process may be the outermost layer of the thermosensitive element, a protective layer applied to the thermosensitive element or a layer on the opposite side of the support to the thermosensitive element.

13 Claims, No Drawings

THERMOGRAPHIC RECORDING MATERIAL WITH IMPROVED SLIP PROPERTIES

FIELD OF THE INVENTION

The present invention relates to a thermographic material suitable for thermal development in dynamic contact with a heat source. In particular, it concerns improvements in imaging properties due to its surface in contact with the heat source having a particular composition.

BACKGROUND OF THE INVENTION

Thermal imaging or thermography is a recording process wherein images are generated by the use of imagewise modulated thermal energy.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Direct thermal thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

According to U.S. Pat. No. 3,080,254 a typical heat-sensitive (thermographic) copy paper includes in the heat-sensitive layer a thermoplastic binder, e.g. ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

Organic heavy metal salt-based direct thermal imaging materials exhibit white lines upon strong changes in print density. WO 94/11199 attempts to solve the white line problem and teaches that a recording material comprising on a support (i) a heat sensitive layer comprising a substantially light insensitive organic silver salt, (ii) a protective layer containing a thermomeltable particle dispersed in a binder and (iii) a reducing agent being present in the heat sensitive layer and/or another layer on the same side of the support carrying the heat sensitive layer. It also teaches that the protective layer may further comprise a lubricant or a lubricant may be present on top of the protective layer.

In the course of the research culminating in the present patent application, it was found that the use of protective layers incorporating thermomeltable particles together with a lubricant or with a lubricant on top of the protective layer as disclosed in WO 94/11199 was insufficient to prevent image faults occurring in the transport direction.

OBJECTS OF THE INVENTION

It is therefore an object of the invention to provide a recording material for which image faults are eliminated under most printing conditions.

It is further object of the invention to provide a thermal imaging process, which eliminates image faults under most printing conditions.

Further objects and advantages of the invention will become apparent from the description hereinafter.

SUMMARY OF THE INVENTION

Surprisingly it has been found that at variance with the teaching of WO 94/11199 in which a protective layer is disclosed comprising thermomeltable wax particles, more preferably with melting points of at least 150° C., dispersed in a binder optionally together with a lubricant, improved slip properties can be achieved by incorporating at least one solid lubricant (thermomeltable wax) with a melting point below 150° C. and at least one liquid lubricant at least one of which being a phosphoric acid derivative.

The above mentioned objects are realised by a recording material comprising at least one thermosensitive element, comprising a substantially light-insensitive organic silver salt and an organic reducing agent therefor in thermal working relationship therewith, on a support, characterized in that an outermost layer of the recording material comprises at least one solid lubricant having a melting point below 150° C. and at least one liquid lubricant in a binder, wherein at least one of the lubricants is a phosphoric acid derivative.

The above objects are also realized by a thermal image forming process comprising the steps of: (i) bringing an outermost layer of the above described recording material into contact with a heat source; (ii) applying heat from the heat source imagewise to said recording material while maintaining mutual contact to but with relative movement between said recording material and the heat source; and (iii) separating the recording material from the heat source.

Preferred embodiments of the invention are disclosed in the dependent claims.

DETAILED DESCRIPTION OF THE INVENTION

According to an embodiment of the present invention a third lubricant is present in the surface layer. This third lubricant may be a phosphoric acid ester and is preferably a solid lubricant.

According to a further embodiment the liquid lubricant is a phosphoric acid derivative.

According to another embodiment of the present invention the solid lubricant with a melting point below 150° C. is a phosphoric acid ester.

According to preferred embodiment a thermal image forming process, according to the present invention, is realized, wherein the heat source is a thin film thermal head.

Lubricants for Outermost Layer

According to the present invention suitable solid lubricants have a melting point below 150° C. Preferred are solid lubricants having a melting point below 110° C., with solid lubricants with a molecular weight below 1000 being particularly preferred. For the purposes of the present invention solid lubricants are defined as those lubricants being solid at room temperature.

Solid lubricants which can be used according to the present invention are polyolefin waxes e.g. polypropylene waxes, ester waxes e.g. fatty acid esters, polyolefin-polyether block copolymers, amide waxes e.g. fatty acid amides, polyglycols e.g. polyethylene glycol, fatty acids, fatty alcohols, natural waxes and solid phosphoric acid derivatives.

Preferred solid lubricants are selected from the group consisting of fatty acid esters, polyolefin-polyether block copolymers and fatty acid amides. Preferred fatty acid esters are glycerine monostearate, glycerine monopalmitate and mixtures of glycerine monostearate and glycerine monopalmitate. Preferred fatty acid amides are selected from the group consisting of ethylenebisstearamide, stearamide, oleamide, myristamide and erucamide.

Examples of suitable solid non-phosphoric acid derivative lubricants according to the present invention with their melting points are:

| | | Melting point [°C.] |
|---|---|---|
| SL01: | ethylenebisstearamide (Ceridust ™ 3910 from Hoechst AG) | 141 |
| SL02: | myristamide | 106 |
| SL03: | stearamide | 104 |
| SL04: | glycerine monostearate | 81 |
| SL05: | erucamide | 80 |
| SL06: | oleamide | 73 |
| SL07: | glycerine tristearate | 55–73 |
| SL08: | Mobilcer ™ Q (a paraffin wax) | 67 |
| SL09: | glycerine monotallow acid ester (Rilanit ™ GMS from Henkel AG) | 55–60 |
| SL10: | sorbitan monostearate (SPAN ™ 60 from ICI PLC) | 55 |
| SL11: | sorbitan tristearate (SPAN ™ 65 from ICI PLC) | 48–53 |
| SL12: | sorbitan monopalmitate (SPAN ™ 40 from ICI PLC) | 44–47 |
| SL13: | POE-(4)-sorbitan monostearate (TWEEN ™ 61 from ICI) | 36–40 |

Examples of suitable phosphoric acid derivative solid lubricants (PSL) according to the present invention with their melting points are:

| | | Melting point [°C.] |
|---|---|---|
| PSL01: | Servoxyl ™ VPAZ 100 from Servo Delden BV (mixture of monolauryl and dilauryl phosphates) | 33 |
| PSL02: | Servoxyl ™ VPRZ 100 from Servo Delden BV (mixture of monocetyl and monostearyl phosphates) | 50 |
| PSL03: | potassium alkyl phosphate (Crafol ™ AP37 from Henkel AG) | 62 |

Examples of suitable non-phosphoric acid derivative liquid lubricants (LL) according to the present invention are:

LL01: glycerine trioleate

LL02: sorbitan monooleate (SPAN™ 80 from Henkel AG)

LL03: sorbitan trioleate (SPAN™ 85 from Henkel AG)

LL04: Tegoglide™ ZG 400 from TEGO-chemie

Examples of suitable phosphoric acid derivative liquid lubricants (PLL) according to the present invention are:

PLL01: Servoxyl™ VPDZ 3 100 from Servo Delden BV {mono [isotridecyl polyglycolether (3 EO)]phosphate}

PLL02: Servoxyl™ VPRZ 6 100 from Servo Delden BV {mono[isotridecyl polyglycolether (6 EO)]phosphate}

PLL03: Servoxyl™ VPFZ 7 100 from Servo Delden BV {mono[oleyl polyglycolether (7 EO)]phosphate}

PLL04: Sermul™ EA224 (=Servoxyl™ VPFZ 7 100) from Servo Delden BV {mono[oleyl polyglycolether (7 EO)]phosphate}

Outermost Layer

The outermost layer of the recording material may in different embodiments of the present invention be the outermost layer of the thermosensitive element, a protective layer applied to the thermosensitive element or a layer on the opposite side of the support to the thermosensitive element.

Protective Layer

The outermost layer surface layer of the recording material according to the present invention may be a protective layer applied to the thermosensitive element to avoid local deformation of the thermosensitive element and to improve resistance against abrasion.

The protective layer preferably comprises a binder, which may be hydrophobic (solvent soluble) of hydrophilic (water soluble). Among the hydrophobic binders polycarbonates as described in EP-A 614 769 are particularly preferred. However, hydrophilic binders are preferred for the protective layer, as coating can be performed from an aqueous composition and mixing of the hydrophilic protective layer with the immediate underlayer can be avoided by using a hydrophobic binder in the immediate underlayer.

A protective layer according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder. The surface active agents may be any agents known in the art such as carboxylates, sulfonates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol and fatty acids.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Hydrophilic Binder for Outermost Layer

According to an embodiment of the present invention the outermost layer of the recording material may comprise a hydrophilic binder. Suitable hydrophilic binders for the outermost layer are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

Crosslinking Agents for Outermost Layer

The outermost layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

Matting Agents for Outermost Layer

The outermost layer of the recording material according to the present invention may comprise a matting agent. Suitable matting agents are described in WO 94/11198 and include e.g. talc particles and optionally protrude from the outermost layer.

Thermosensitive Element

The thermosensitive element, according to the present invention comprises a substantially light-insensitive organic silver salt and an organic reducing agent therefor in thermal working relationship therewith. The element may comprise a layer system in which the ingredients may be dispersed in different layers, with the proviso that the substantially light-insensitive organic silver salt and the organic reducing agent are in thermal working relationship with one another i.e. during the thermal development process the reducing agent must be present in such a way that it is able to diffuse to said substantially light-insensitive organic silver salt particles so that reduction of the organic silver salt can take place.

Organic Silver Salts

Preferred organic silver salts according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, with silver behenate being particularly preferred. Such silver salts are also called "silver soaps". In addition silver dodecyl sulphonate described in U.S. Pat. No. 4,504,575; and silver di-(2-ethylhexyl)-sulfosuccinate described in EP-A 227 141, modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

The silver image density depends on the coverage of the above defined reducing agent(s) and organic silver salt(s) and has to be preferably such that, on heating above 100° C., an optical density of at least 2.5 can be obtained.

Reducing Agents

Suitable organic reducing agents for the reduction of said substantially light-insensitive organic silver salts are organic compounds containing at least one active hydrogen atom linked to O, N or C, such as is the case with, aromatic di- and tri-hydroxy compounds; aminophenols; METOL (tradename); p-phenylenediamines; alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol, pyrogallol, gallic acid and gallic acid esters are preferred. Particularly useful are polyhydroxy spiro-bis-indane compounds, especially these corresponding to the following general formula (I):

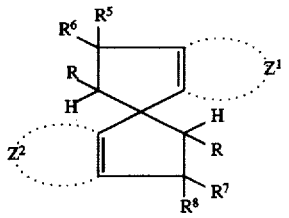

wherein:

R represents hydrogen or alkyl, e.g. methyl or ethyl, each of $R^5$ and $R^6$ (same or different) represents, an alkyl group, preferably methyl group or a cycloalkyl group, e.g. cyclohexyl group, each of $R^7$ and $R^8$ (same or different) represents, an alkyl group, preferably methyl group or a cycloalkyl group, e.g. cyclohexyl group, and each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g. an alkyl or aryl group.

In particular are mentioned the polyhydroxy-spiro-bis-indane compounds described in U.S. Pat. No. 3,440,049 as photographic tanning agent, more especially 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II). Indane is also known under the name hydrindene.

Among the catechol-type reducing agents, i.e. reducing agents containing at least one benzene nucleus with two hydroxy groups (—OH) in ortho-position, the following are preferred: catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters. Particularly preferred catechol-type reducing agents, described in EP-A 692 733, are benzene compounds in which the benzene nucleus is substituted by no more than two hydroxy groups which are present in 3,4-position on said nucleus and have in the 1-position of said nucleus a substituent linked to said nucleus by means of a carbonyl group.

The silver image density depends upon the coverage of reducing agent and organic silver salt and has preferably to be such that upon heating an optical density of at least 2.5 can be obtained. Preferably at least 0.10 moles of reducing agent per mole of organic silver salt is used.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic silver salt such as silver behenate, such as described in U.S. Pat. No. 4,001, 026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols corresponding to the following general formula Aryl-$SO_2$—NH-Arylene-OH in which Aryl represents a monovalent aromatic group, and Arylene represents a bivalent aromatic group, having the —OH group preferably in para-position to the —$SO_2$—NH— group.

Sulfonamidophenols according to the above defined general formula are described in the periodical Research Disclosure, February 1979, item 17842, in U.S. Pat. Nos. 4,360,581 and 4,782,004, and in published European Patent Application No. 423 891, wherein these reducing agents are mentioned for use in a photothermographic recording material in which photosensitive silver halide is present in catalytic proximity to a substantially light-insensitive silver salt of an organic acid.

Other auxiliary reducing agents that may be used in conjunction with the above mentioned primary reducing agents are organic reducing metal salts, e.g. stannous stearate described in U.S. Pat. Nos. 3,460,946 and 3,547,648.

Film-forming Binders of the Thermosensitive Element

The film-forming binder of the thermosensitive element containing the substantially light-insensitive organic silver salt may be all kinds of natural, modified natural or synthetic resins or mixtures of such resins, wherein the organic silver salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

A particularly suitable polyvinyl butyral containing a minor amount of vinyl alcohol units is marketed under the trade name BUTVAR B79 of Monsanto USA and provides a good adhesion to paper and properly subbed polyester supports.

The binder to organic silver salt weight ratio is preferably in the range of 0.2 to 6, and the thickness of the recording layer is preferably in the range of 5 to 50 μm.

The layer containing the organic silver salt is commonly coated onto a support in sheet- or web-form from an organic solvent containing the binder dissolved therein, but may be applied from an aqueous medium as a latex, i.e. as an aqueous polymer dispersion. For use as a latex the dispersible polymer has preferably some hydrophilic functionality. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776 and 4,740,446, in EP-A 119 615 and 122 512, and in DE-A 3 339 810.

Toning Agents

In order to obtain a neutral black image tone in the higher densities and neutral grey in the lower densities the recording layer contains preferably in admixture with said organic silver salts and reducing agents a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type within the scope of following general formula

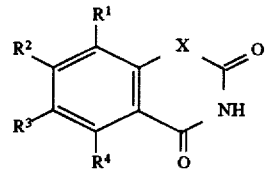

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. Toners within the scope of said general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

Other Ingredients

The recording layer may contain in addition to the ingredients mentioned above other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG—GERMANY), ultraviolet light absorbing compounds, white light reflecting and/or ultraviolet radiation reflecting pigments, silica, and/or optical brightening agents.

Support

The support for the thermal imaging material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. For example, a paper base substrate is present which may contain white reflecting pigments, optionally also applied in an interlayer between the recording material and said paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, said base may be colourless or coloured, e.g. having a blue colour.

Antistatic Layer

In a preferred embodiment the recording material of the present invention an antistatic layer is applied to the outermost layer not comprising at least one solid lubricant having a melting point below 150° C. and at least one liquid lubricant in a binder, wherein at least one of said lubricants is a phosphoric acid derivative. Suitable antistatic layers therefor are described in EP-A 440 957.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Processing Configurations

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300° to 400° C. and the heating time per picture element (pixel) may be 50 ms or less, the pressure contact of the thermal printhead with the recording material being e.g. 100–500 g/cm$^2$ to ensure a good transfer of heat.

In a particular embodiment of the method according to the present invention the direct thermal image-wise heating of the recording material proceeds by Joule effect heating in that selectively energized electrical resistors of a thermal head array are used in contact or close proximity with said recording layer. Suitable thermal printing heads are e.g. a Fujitsu Thermal Head (FTP-040 MCS001), a TDK Thermal Head F415 HH7-1089 and a Rohm Thermal Head KE 2008-F3.

The image signals for modulating the current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

When used in thermographic recording operating with thermal printheads said recording materials will not be suited for reproducing images with fairly large number of grey levels as is required for continuous tone reproduction.

According to EP-A 622 217 relating to a method for making an image using a direct thermal imaging element, improvements in continuous tone reproduction are obtained by heating the thermal recording element by means of a thermal head having a plurality of heating elements, characterized in that the activation of the heating elements is executed line by line with a duty cycle Δ representing the ratio of activation time to total line time in such a way that the following equation is satisfied:

$$P \leq P_{max} = 3.3\ W/mm^2 + (9.5\ W/mm^2 \times \Delta)$$

wherein $P_{max}$ is the maximal value over all the heating elements of the time averaged power density P (expressed in W/mm$^2$) dissipated by a heating element during a line time.

Direct thermal imaging can be used for both the production of transparencies and reflection type prints. In the hard copy field recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims.

The invention is illustrated hereinafter by way of invention examples and comparative examples. The percentages and ratios given in these examples are by weight unless otherwise indicated.

INVENTION EXAMPLES 1 to 2 and COMPARATIVE EXAMPLES 1 to 9 coating of the thermosensitive element

A subbed polyethylene terephthalate support having a thickness of 175 μm was doctor blade-coated with a coating composition containing butanone as a solvent and the following ingredients so as to obtain thereon, after drying for 1 hour at 50° C., a layer containing:

| | |
|---|---|
| silver behenate | 4.74 g/m² |
| polyvinylbutyral (Butvar™ B79 from Monsanto) | 18.92 g/m² |
| silicone oil (Baysilone™ from Bayer AG) | 0.043 g/m² |
| benzo[e][1,3]oxazine-2,4-dione, a toning agent | 0.260 g/m² |
| 7-(ethylcarbonato)-benzo[e][1,3]oxazine-2,4-dione, a toning agent (see formula II below) | 0.133 g/m² |
| butyl 3,4-dihydroxybenzoate, a reducing agent | 1.118 g/m² |
| tetrachlorophthalic anhydride | 0.151 g/m² |
| pimelic acid | 0.495 g/m² |

II)

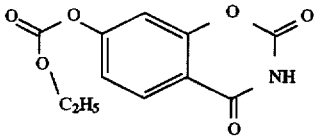

coating of thermosensitive element with a surface protective layer

The thermosensitive element was then coated with different aqueous compositions with the following basic composition expressed as weight percentages of ingredients present:

2.5% polyvinylalcohol (Mowiviol™ WX 48 20 from Wacker Chemie)

0.09% Ultravon™ W (dispersion agent from Ciba Geigy) converted into acid form by passing through an ion exchange column 0.11% talc (type P3 from Nippon Talc)

1.2% of colloidal silica (Levasil™ VP AC 4055 from Bayer AG, a 15% aqueous dispersion of colloidal silica)

2.1% tetramethylorthosilicate hydrolyzed in the presence of methanesulfonic acid and lubricants in the concentrations given as weight percentages in the tables below The pH of the coating composition was adjusted to a pH of 4 by adding 1N nitric acid. Those lubricants in these compositions which were insoluble in water, were dispersed in a ball mill with, if necessary, the aid of a dispersion agent. The compositions were coated to a wet layer thickness of 85 μm and were then dried at 40° C. for 15 minutes and hardened at 45° C. and a relative humidity of 70% for 7 days.

Printing and Evaluation

After hardening, a commercially available AGFA DRYSTAR™ 2000 (thermal head) printer with a maximum electrical input energy per dot of 63 mW was used to produce an image over the whole width of the thermal head consisting of 11 blocks each printed at different electrical energies per dot and each with a non-printed strip in the middle thereof 2 mm wide in the printing direction and 18 cm long lateral to the printing direction, while printing the 2 mm wide and 2 cm long strips either side thereof. The degree to which the print obtained distinguished between these 2 mm wide laterally adjoining non-printed and printed strips was used as a measure of the image quality attained i.e. whether or not the two 2 mm wide and 2 cm long printed strips either side of the 2 mm wide and 18 cm long non-printed strip had been faithfully reproduced. Any non-uniform transport along the thermal head will result in the printed strips either side of the long non-printed strip not being faithfully reproduced with in the case of extremely non-uniform transport none of the 2 mm wide strips being printed i.e. additional thick white lines being observed. The prints were visually evaluated on a scale of 5 to 0 according to the following criteria:

5, very bad: clearly visible additional thick white lines either side of each non-printed strip 2 mm wide and 18 cm long 4, bad: clearly visible additional white lines at a distance >>20 cm either side of each non-printed strip 2 mm wide and 18 cm long 3, fair: additional white lines visible at a viewing distance of 20 cm either side of each non-printed strip 2 mm wide and 18 cm long 2, good: additional white lines only visible at a viewing distance <<20 cm either side of each non-printed strip 2 mm wide and 18 cm long 1, very good: additional white lines only faintly visible either side of each non-printed strip 2 mm wide and 18 cm long 0, excellent: no additional white lines visible These values are given below in table 1 for comparative examples 1 to 9 and in table 2 for invention examples 1 to 2.

TABLE 1

| Comparative example | Solid lubricant code | Solid lubricant concentration[%] | Liquid lubricant code | Liquid lubricant concentration[%] | Image quality |
|---|---|---|---|---|---|
| 1 | SL01 | 0.18 | — | — | 3 |
| 2 | SL01 | 0.36 | — | — | 3 |
| 3 | SL09 | 0.18 | — | — | 4 |
| 4 | SL09 | 0.36 | — | — | 4 |
| 5 | PSL01 | 0.09 | — | — | 5 |
| 6 | — | — | LL04 | 0.18 | 5 |
| 7 | — | — | LL04 | 0.36 | 5 |
| 8 | — | — | PLL01 | 0.18 | 4 |
| 9 | SL01 | 0.2 | LL04 | 0.1 | 5 |

These comparative examples teach that increasing the concentration of solid or liquid lubricants in the surface layer, whether they be phosphoric acid derivatives or not, a good image quality can not be attained, even at concentrations of 0.36%, as in the cases of comparative examples 2, 4 and 7. Further increasing the concentrations of these lubricants leads to greasy surfaces and unacceptable image haziness. Comparative example 13 teaches that a combination of a solid lubricant and a liquid lubricant when neither is a phosphoric acid derivative, as disclosed in WO 94/11199, results in a very poor image quality.

TABLE 2

| Invention example | Solid lubricant code | Solid lubricant concentration | Liquid lubricant code | Liquid lubricant concentration | Image quality |
|---|---|---|---|---|---|
| 1 | SL11 | 0.18 | PLL01 | 0.09 | 2 |
| 2 | PSL01 | 0.18 | PLL01 | 0.09 | 1 |

These invention examples teach that the use of a combination of a solid and a liquid lubricant both with melting points below 150° C. and at least one of which being a phosphoric acid derivative in the surface layer of a recording material according to the present invention produces a marked improvement in image quality. Moreover, the surface of the prints was dry and non-greasy.

INVENTION EXAMPLES 3 to 22

The recording materials of invention examples 3 to 22 were produced as described for invention examples 1 to 2 except that an additional solid lubricant was incorporated into the protective layer.

Printing and evaluation were carried out as described for invention examples 1 to 2 and the results are summarized in table 3 below.

TABLE 3

| | Solid lubricant | | Liquid lubricant | | Third lubricant | | |
|---|---|---|---|---|---|---|---|
| Invention example | code | concentration[%] | code | concentration[%] | code | concentration[%] | Image quality |
| 3 | SL01 | 0.1 | PLL01 | 0.1 | PSL01 | 0.05 | 2 |
| 4 | SL01 | 0.2 | PLL01 | 0.1 | PSL01 | 0.025 | 2 |
| 5 | SL01 | 0.2 | PLL01 | 0.1 | PSL01 | 0.05 | 2 |
| 6 | SL01 | 0.2 | PLL01 | 0.1 | PSL01 | 0.1 | 0 |
| 7 | SL01 | 0.2 | PLL01 | 0.1 | PSL02 | 0.1 | 1 |
| 8 | SL01 | 0.2 | PLL04 | 0.1 | PSL01 | 0.1 | 0 |
| 9 | SL01 | 0.2 | LL04 | 0.1 | PSL01 | 0.3 | 1 |
| 10 | SL01 | 0.4 | LL04 | 0.1 | PSL01 | 0.1 | 1 |
| 11 | SL02 | 0.2 | PLL01 | 0.1 | PSL01 | 0.1 | 2 |
| 12 | SL03 | 0.2 | PLL01 | 0.1 | PSL01 | 0.1 | 1 |
| 13 | SL04 | 0.18 | PLL01 | 0.09 | PSL01 | 0.09 | 2 |
| 14 | SL05 | 0.2 | PLL01 | 0.1 | PSL01 | 0.1 | 1 |
| 15 | SL06 | 0.2 | PLL01 | 0.1 | PSL01 | 0.1 | 2 |
| 16 | SL09 | 0.2 | PLL01 | 0.1 | PSL01 | 0.1 | 1 |
| 17 | SL09 | 0.2 | PLL01 | 0.1 | PSL01 | 0.1 | 1 |
| 18 | SL09 | 0.18 | PLL01 | 0.09 | PSL01 | 0.09 | 2 |
| 19 | SL10 | 0.18 | PLL01 | 0.09 | PSL01 | 0.09 | 2 |
| 20 | SL11 | 0.18 | PLL01 | 0.09 | PSL01 | 0.09 | 0 |
| 21 | SL12 | 0.18 | PLL01 | 0.09 | PSL01 | 0.09 | 1 |
| 22 | SL13 | 0.18 | PLL01 | 0.09 | PSL01 | 0.09 | 2 |

Invention examples 3 to 22 teach that the use of a combination of two solid and one liquid lubricant all with melting points below 150° C. and at least one of which being a phosphoric acid derivative in the surface layer of a recording material according to the present invention produces a marked improvement in image quality. Moreover, the surface of the prints was dry and non-greasy.

INVENTION EXAMPLES 23 to 26

The recording materials of invention examples 23 to 26 were produced as described for invention examples 1 to 2 except that an additional liquid lubricant was incorporated into the protective layer.

Printing and evaluation were carried out as described for invention examples 1 to 2 and the results are summarized in table 4 below.

TABLE 4

| | Solid lubricant | | Liquid lubricant | | Third lubricant | | |
|---|---|---|---|---|---|---|---|
| Invention example | code | concentration[%] | code | concentration[%] | code | concentration[%] | Image quality |
| 23 | SL01 | 0.2 | PLL01 | 0.1 | PLL02 | 0.1 | 2 |
| 24 | SL01 | 0.2 | PLL01 | 0.1 | PLL03 | 0.1 | 2 |
| 25 | PSL01 | 0.09 | PLL01 | 0.09 | LL02 | 0.18 | 2 |
| 26 | PSL01 | 0.09 | PLL01 | 0.09 | LL03 | 0.18 | 2 |

Invention examples 23 to 26 teach that the use of a combination of one solid and two liquid lubricants all with melting points below 150° C. and at least one of which being a phosphoric acid derivative in the surface layer of a recording material according to the present invention produces improvement in image quality. Moreover, the surface of the prints was dry and non-greasy.

Having described in detail preferred embodiments of the current invention, it will now be apparent to those skilled in the art that numerous modifications can be made therein without departing from the scope of the invention as defined in the following claims.

We claim:

1. A recording material comprising at least one thermosensitive element, comprising a substantially light-insensitive organic silver salt and an organic reducing agent therefor in thermal working relationship therewith, on a support, characterized in that an outermost layer of said recording material comprises at least one solid lubricant having a melting point below 150° C. and at least one liquid lubricant in a binder, wherein at least one of said lubricants is a phosphoric acid derivative.

2. The recording material according to claim 1, wherein in addition a third lubricant is present in said outermost layer.

3. The recording material according to claim 1, wherein said solid lubricant is selected from the group consisting of a fatty acid ester, a polyolefin-polyether block copolymer and a fatty acid amide.

4. The recording material according to claim 3, wherein said fatty acid ester is glycerine monostearate, glycerine monopalmitate or a mixture of glycerine monostearate and glycerine monopalmitate.

5. The recording material according to claim 3, wherein said fatty acid amide is selected from the group consisting of ethylenebisstearamide, stearamide, oleamide, myristamide and erucamide.

6. The recording material according to claim 1, wherein the outermost layer of said thermosensitive element is said outermost layer.

7. The recording material according to claim 1, wherein said outermost layer is a protective layer applied to said thermosensitive element.

8. The recording material according to claim 1, wherein said outermost layer further comprises a hydrophilic binder.

9. The recording material according to claim 1, wherein said outermost layer is crosslinked.

10. The recording material according to claim 1, wherein said outermost layer further comprises a matting agent.

11. The recording material according to claim 1, wherein said substantially light-insensitive organic silver salt is a substantially light-insensitive fatty acid silver salt.

12. A thermal image forming process comprising the steps of: (i) bringing an outermost layer of a recording material comprising at least one thermosensitive element, comprising a substantially light-insensitive organic silver salt and an organic reducing agent therefor in thermal working relationship therewith, on a support into contact with a heat source; (ii) applying heat from said heat source imagewise to said recording material while maintaining mutual contact to but with relative movement between said recording material and said heat source; and (iii) separating said recording material from said heat source, characterized in that said outermost layer comprises at least one solid lubricant having a melting point below 150° C. and at least one liquid lubricant in a binder, wherein at least one of said lubricants is a phosphoric acid derivative.

13. The thermal image forming process according to claim 12, wherein said heat source is a thin film thermal head.

* * * * *